US005601287A

United States Patent [19]

Lundin

[11] Patent Number: 5,601,287

[45] Date of Patent: Feb. 11, 1997

[54] SYSTEM FOR DRAWING WINNERS IN A LOTTERY

[76] Inventor: Per Lundin, Brandmansgatan 8, S-421 68 Västra Frölunda, Sweden

[21] Appl. No.: 382,020

[22] PCT Filed: Aug. 7, 1992

[86] PCT No.: PCT/SE92/00543

§ 371 Date: Feb. 7, 1995

§ 102(e) Date: Feb. 7, 1995

[87] PCT Pub. No.: WO94/03873

PCT Pub. Date: Feb. 17, 1994

[51] Int. Cl.[6] ..... A63F 3/06

[52] U.S. Cl. ..... 273/138.2; 273/269; 463/19

[58] Field of Search ..... 273/269, 138 A, 273/138.2; 463/19, 18, 17

[56] References Cited

U.S. PATENT DOCUMENTS

| | | | |
|---|---|---|---|
| 3,653,026 | 3/1972 | Hurley | 340/323 |
| 4,312,511 | 1/1982 | Jullien | 273/237 |
| 4,332,389 | 6/1982 | Loyd, Jr. et al. | 273/237 |
| 4,378,940 | 4/1983 | Gluz et al. | 273/237 |
| 4,669,729 | 6/1987 | Solitt et al. | 273/138 A |
| 4,909,516 | 3/1990 | Kolinsky | 273/237 |
| 5,035,422 | 7/1991 | Berman | 273/439 |
| 5,096,202 | 3/1992 | Hesland | 273/237 |
| 5,351,970 | 10/1994 | Fioretti | 273/439 |

FOREIGN PATENT DOCUMENTS

| | | |
|---|---|---|
| 0310368A2 | 9/1988 | European Pat. Off. . |
| 197971 | 11/1986 | United Kingdom . |

*Primary Examiner*—Benjamin H. Layno
*Attorney, Agent, or Firm*—Klarquist, Sparkman, Campbell, Leigh & Whinston, LLP

[57] ABSTRACT

System for use of a microprocessor for drawing of winners in a lottery with an in advance given dividend, at which each lottery ticket includes at least one counter of bingo type with a number in rows and columns provided numbers as well as for the lottery ticket unique identification. The identification of each lottery ticket and number row of a counter are stored in a first register which is readable by a microprocessor, that a number of number sequences are created and stored in a second register which is readable by a microprocessor, in such a way that each of the number sequences is unique and gives a number of prize-winning rows of numbers among the counters, which number corresponds to the given dividend. One of the number sequences in the second register is selected by a random draw. The microprocessor compares this chosen number sequence with the number rows in the first register and shows the identification that indicates counters with a prize-winning row of numbers.

7 Claims, 2 Drawing Sheets

SYSTEM FOR DRAWING WINNERS IN A LOTTERY

TECHNICAL FIELD

The present invention refers to a system for use of a microprocessor at drawing of winners in a lottery with an in advance given dividend, whereby each lottery ticket includes at least one counter of bingo type with a number of numbers provided in rows and columns as well as an identification that is unique for the lottery ticket.

PRIOR ART

At conventional lotteries one simply draws prize tickets from the total number of lottery tickets, until an in advance given number of prize tickets has been obtained. The results of such draws are published by means of lottery prize-list. A disadvantage of usual lotteries is that the excitement moment is short-lived.

Interactive games of bingo type engages the participants considerably more and are therefore experienced as more exciting. A problem at games of bingo type is that the random draw of numbers gives an unpredictable dividend. It is true, that the dividend in long-term can be statistically calculated, but the uncertainty is yet very big before each individual draw.

THE TECHNICAL PROBLEM

The purpose of the invention is therefore to achieve a system that makes it possible to achieve an in advance given dividend at games of bingo type.

THE SOLUTION

For this object the invention is characterized in that the identification of each lottery ticket and number row of a counter are stored in a first register which is readable by a microprocessor, that a number of number sequences are created and stored in a second register which is readable by a microprocessor, in such a way that each of the number sequences is unique and gives a number of prize-winning rows of numbers among the counters, which number corresponds to the given dividend, that one of the number sequences in the second register is selected by a random draw, and that the microprocessor compares this chosen number sequence with the number rows in the first register and shows the identifications that indicate counters with a prize-winning row of numbers.

Advantageous variants of the invention are illustrated by the subsequent subclaims.

BRIEF DESCRIPTION OF DRAWINGS

Embodiments of the invention will now be described here below with reference to the accompanying drawings in which.

PREFERRED EMBODIMENTS

Figure 1:
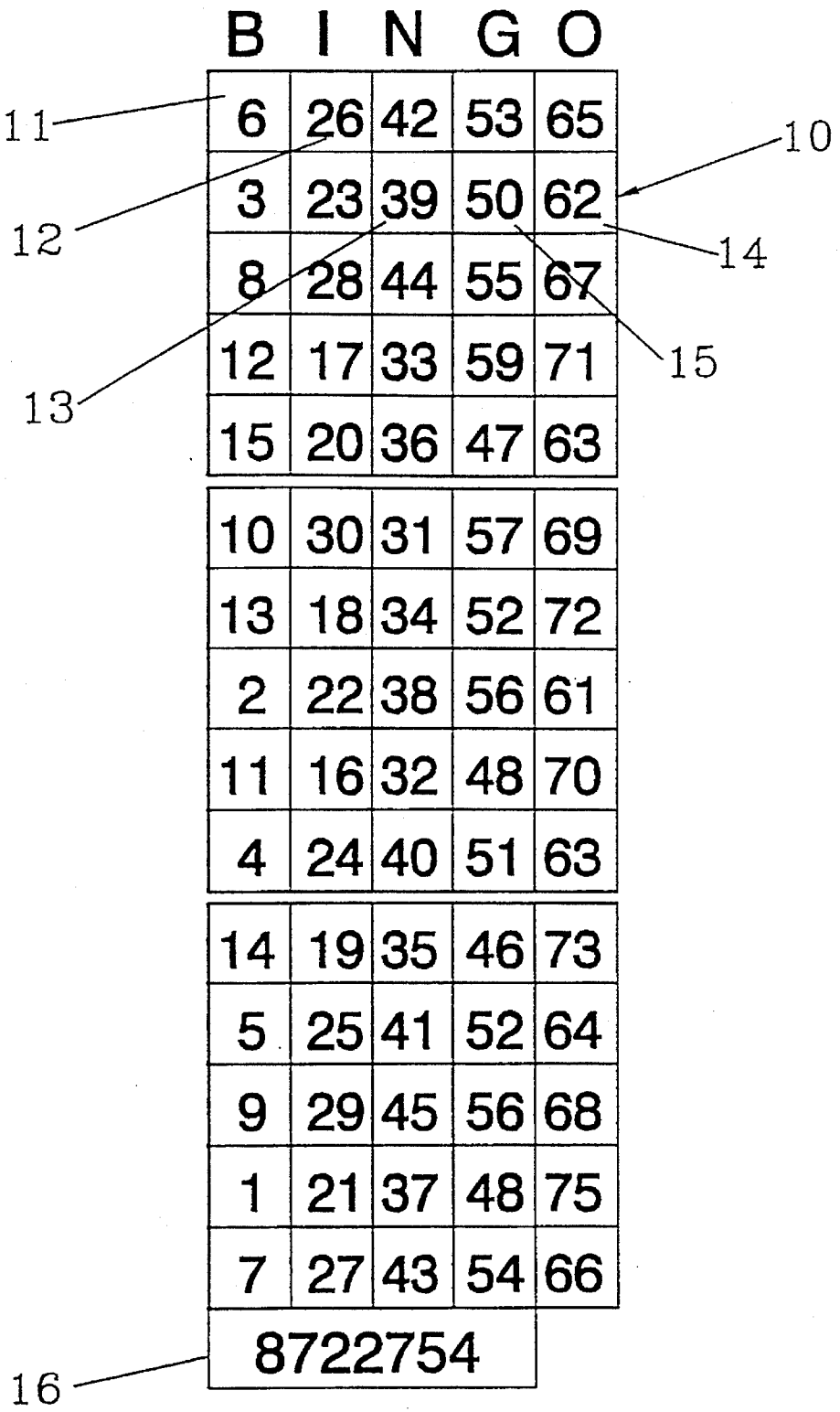
FIG. 1 shows a Bingo-style lottery ticket with a counter in accordance with one aspect of the invention.

The system according to the invention is based on the use of the conventional bingo-counter 10 for variation games, as shown in FIG. 1. Normally such a counter 10 includes 75 numbers distributed in five columns 11–15 with 15 rows each, with numbers 1–15 in the first column 11, 16–30 in the second column 12, 31–45 in the third column 13, 40–60 in the fourth column 14, and 61–75 in the fifth column 15. The invention is however not limited to this size, but can be modified regarding the number of rows and columns.

There are a total of 50,62.5 different ways to combine a bingo counter with 75 numbers in the five columns 11–15. Each lottery ticket includes at least one of these counters 10. It can manageably be appropriate to use series of, for example, 10,000 lottery tickets per series. Then 10,000 of the total number of bingo counters are selected. The counters are each printed and provided with an identification number 16, so that every lottery ticket in each series has a unique counter and a unique identification number 16. If several series are present, for example, nine, there are therefore 90,000 lottery tickets with nine identical counter series and 90,000 different lottery ticket numbers 16.

Figure 2:
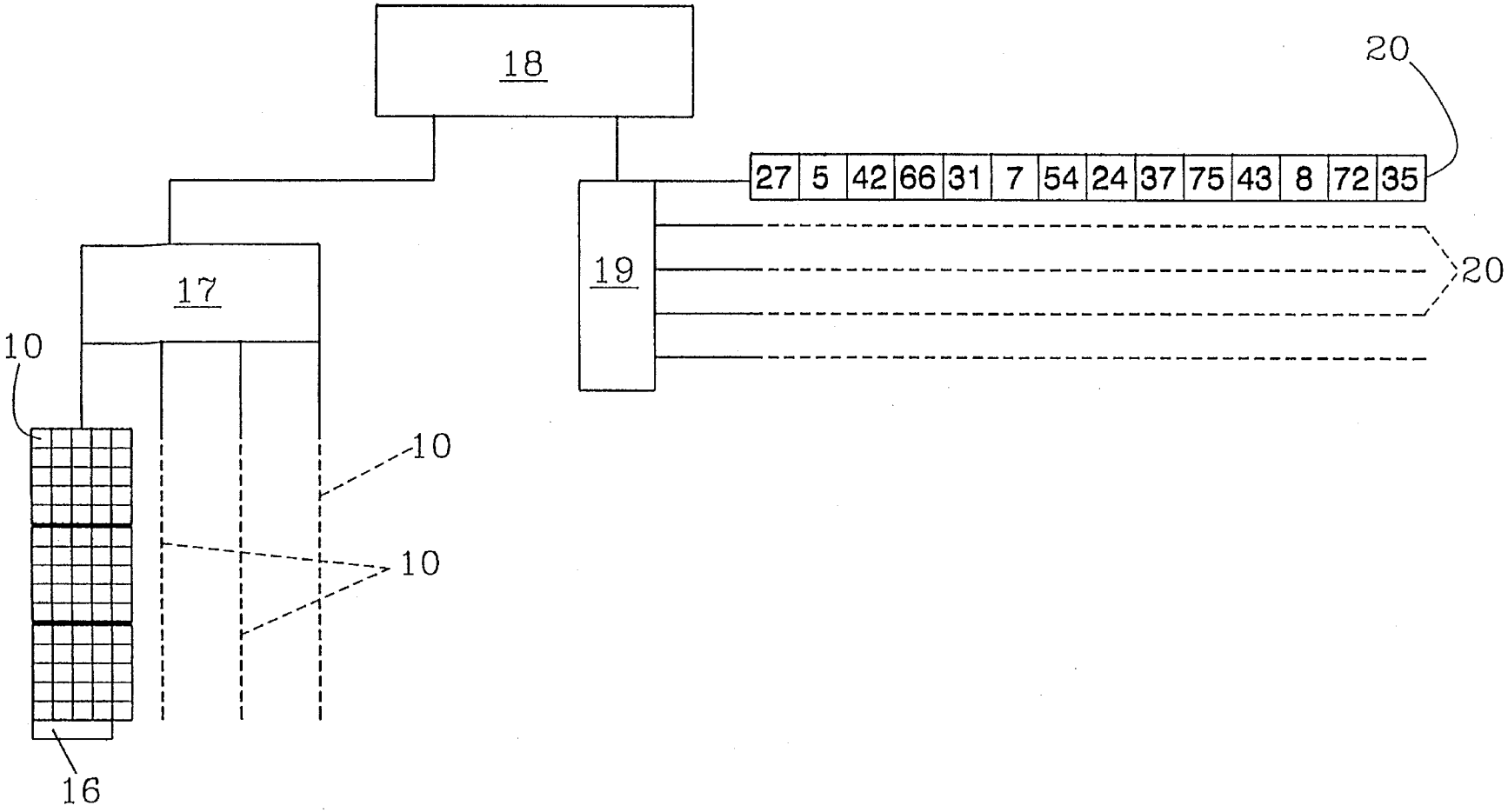
FIG. 2 shows a microprocessor with memory registers for operating a lottery under the present invention.

Each lottery ticket number 16 in a series consequently represents a unique counter 10. As shown in FIG. 2, the lottery ticket numbers 16 and their respective counters 10 are stored in a first register 17 readable by a microprocessor 18.

Before each draw the prize plan shall be known. One can, for example, choose that there shall be 90 winners per 10,000 lottery tickets. The draw is carried out after sale is completed and before the presentation of the draw result. This presentation may, for example, be carried out on TV, in such a way that it seems as if the draw, being of bingo character, is done in the moment of broadcasting. The presentation can furthermore be published in the daily press after the broadcasting.

In a second register 19 readable by a microprocessor 18, a number of number sequences 20 are stored, which include 17–20 different numbers between 1 and 75. These number sequences are unique and constructed such, that they give an exact number of winners at the use of 10,000 counters. To satisfy the demand of randomness the plurality of number sequences may for example comprise 2,000 sequences.

The draw is carried out by randomly selecting a number sequence among the mentioned 2,000 in the second register 19. Thus it is an entirely random sample that determines which 90 counters per series that are winners.

After this draw a computer run takes place in which the selected number sequence 20 is compared to the counters 10 in the first register 17. In this way winning lottery counter numbers 16 are successively put together until all winning counters in all series have been identified.

It is now possible to carry out the presentation of the selected number sequence 20, for example in live TV, in such a way that the spectators may get the impression that the draw, of bingo game character, occurs in the moment of broadcasting.

The creation of number sequences 20 is carried out by means of a random number generator in the computer. At first five lists of random numbers (one per column 11–15) are generated with random mutual order of the numbers 1–15 in the first list, 16–30 in the second list, 31–45 in the third list, 46–60 in the fourth list and 61–75 in the fifth list. Subsequently a random number between one and five is generated. This number selects the list of random numbers (column) from which the next number shall be drawn. Then a suitable number in each of the five lists of random numbers is drawn by means of a new random number between 1–15 for each draw. This random number between 1–15 points onto a position in the previously arranged list of random numbers. In other words, the new random number between 1 and 15 in the column selected by the random number between one and five corresponds to one of the fifteen positions in that column. This position contains the number that shall be used next in the number sequence. In this way the function of random numbers of the computer is used twice to obtain a drawn number. Furthermore it is provided that the order among the numbers generated is mixed, so that not all numbers from the same column appear consecutively, which might appear non-randomly to the public. The distribution of numbers from the different columns is done in an appropriate way in relation to the number of winners, for example a draw of three numbers in column 1, two numbers in column 2, five numbers in column 3, one number in column 4 and three numbers in column 5 give a total of 90 winners.

In this way each number sequence 20 is generated. The computer is now used for going through and ascertaining on which lottery counters 10 there is a horizontal line with five drawn numbers. If the number of winning counters corresponds to the given dividend this number sequence 20 is accepted, in other case it is rejected. In this way accepted number sequences 20 are generated until the numbers form a statistical distribution number (i.e., a statistical distribution number refers to a group of accepted number sequences which are large enough to be statistically acceptable with regard to randomness in relation to the number of lottery counters in each series. If the group of accepted number sequences is not large enough, some numbers will not be present in this group of number sequences and will therefore be excluded from the draw.) in relation to the number of lottery counters in each series.

After a completed lottery round the selected number sequence 20 is erased from the second register 19. A new number sequence 20 is instead created in the above described way, so that before each lottery round there is always available the amount of number sequence 20 determined in advance to select from.

The system according to the invention is very flexible and can easily be adapted to various average distributions of dividend.

The invention is not limited to the above described embodiments, but several variants are conceivable within the scope of subsequent claims. For example counters with more or fewer numbers than described above can be used.

I claim:

1. A method for drawing winners in a lottery with a predetermined prize dividend comprising the steps of:

(a) providing a plurality of printed bingo type lottery tickets that are each provided with a unique identification number and a unique counter comprising a quantity of different numbers arranged in rows and columns, the numbers arranged across each row being row number sequences that are played in the lottery;

(b) storing the identification number and the row number sequences of each lottery ticket in a first register readable by a microprocessor;

(c) creating a plurality of drawing number sequences by means of a computer in such a way that each of the drawing number sequences is unique and gives a selected number of prizewinning row number sequences among the counters on the plurality of tickets, which selected number of prizewinning row number sequences corresponds to the predetermined prize dividend;

(d) storing said plurality of drawing number sequences in a second register that is readable by the microprocessor;

(e) selecting one number sequence of the plurality of drawing number sequences by a random draw among said plurality of drawing number sequences stored in the second register;

(f) comparing the selected number sequence by means of the microprocessor to the row number sequences stored in the first register;

(g) identifying row number sequences whose numbers are comprised in the selected number sequence by means of the microprocessor; and (h) presenting the selected number sequence.

2. A method according to claim 1, wherein numbers in the selected number sequences are presented one by one in a bingo-manner.

3. A method according to claim 1, wherein the first register contains all possible different row number sequences.

4. A method according to claim 1, wherein the first register contains a selected quantity of row number sequences.

5. A method according to claim 1, wherein the plurality of drawing number sequences in the second register comprises at least so many number sequences, that the number sequences form a statistical distribution amount in relation to the quantity of row number sequences.

6. A method according to claim 1, wherein each number sequence is created with consideration to the quantity of row number sequences, to the number of winners in the predetermined prize dividend and to a required length of the number sequence to indicate winning row number sequences.

7. A method according to claim 1, wherein the ticket includes the numbers 1–75, arranged in five columns each with fifteen number positions, and wherein each number sequence is created by means of the internal random number generator of a computer, wherein first, second, third, fourth and fifth lists of random numbers are generated to correspond to the five number columns in the ticket, with random mutual order of the numbers 1–15 in the first list, 16–30 in the second list, 31–45 in the third list, 46–60 in the fourth list and 61–75 in the fifth list and wherein a random number between one and five is generated, which random number selects from which of the first, second, third, fourth and fifth lists of random number the next number shall be drawn, that one to five numbers are drawn in each of the lists of random numbers by means of a new random number between 1–15 for each draw, which random number selects one of the number positions in the current list of random numbers, so that this position contains the number that shall be used in the number sequence.

* * * * *

UNITED STATES PATENT AND TRADEMARK OFFICE

CERTIFICATE OF CORRECTION

PATENT NO. : 5,601,287

DATED : February 11, 1997

INVENTOR(S) : Per Lundin

It is certified that error appears in the above-identified patent and that said Letters Patent is hereby corrected as shown below:

Column 2, line 7, "50,62.5" should read --50,625--.

Signed and Sealed this

Sixteenth Day of December, 1997

Bruce Lehman

*Attest:*

BRUCE LEHMAN

*Attesting Officer*

*Commissioner of Patents and Trademarks*